US009100762B2

(12) United States Patent
Gran

(10) Patent No.: US 9,100,762 B2
(45) Date of Patent: Aug. 4, 2015

(54) HEARING AID WITH IMPROVED LOCALIZATION

(71) Applicant: GN ReSound A/S, Ballerup (DK)

(72) Inventor: Karl-Fredrik Johan Gran, Malmo (SE)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 13/901,386

(22) Filed: May 23, 2013

(65) Prior Publication Data

US 2014/0348360 A1 Nov. 27, 2014

(30) Foreign Application Priority Data

May 22, 2013 (DK) ..... 2013 70273
May 22, 2013 (EP) ..... 13168718

(51) Int. Cl.
*H04R 25/00* (2006.01)

(52) U.S. Cl.
CPC ..... *H04R 25/50* (2013.01); *H04R 25/407* (2013.01); *H04R 25/453* (2013.01); *H04R 2225/021* (2013.01); *H04R 2225/025* (2013.01); *H04R 2225/43* (2013.01); *H04R 2410/01* (2013.01)

(58) Field of Classification Search
CPC .... H04R 25/40; H04R 25/405; H04R 25/407; H04R 25/45; H04R 25/453; H04R 2225/021; H04R 2225/023; H04R 2225/025; H04R 2225/43; H04R 2410/01; H04R 2460/01
USPC ..... 381/312, 313, 317, 318, 320, 314, 321, 381/330
See application file for complete search history.

(56) References Cited

U.S. PATENT DOCUMENTS 5,325,463 A 6/1994 Murata et al.
5,473,702 A 12/1995 Yoshida et al.
(Continued)

FOREIGN PATENT DOCUMENTS

EP 1 414 268 4/2004
EP 1 594 344 11/2005
(Continued)

OTHER PUBLICATIONS

First Technical Examination and Search Report dated Nov. 18, 2013 for related Danish Patent Application No. PA 2013 70273, 4 pages.
(Continued)

*Primary Examiner* — Curtis Kuntz
*Assistant Examiner* — Joshua A Kaufman
(74) *Attorney, Agent, or Firm* — Vista IP Law Group, LLP

(57) ABSTRACT

A hearing aid includes: a BTE hearing aid housing configured to be worn behind a pinna of a user and accommodating at least one BTE sound input transducer configured for conversion of acoustic sound into a BTE audio sound signal; an ITE microphone housing configured to be positioned in an outer ear of the user and accommodating at least one ITE microphone configured for conversion of acoustic sound into an ITE audio sound signal and accommodated by the ITE microphone housing; a signal detector configured for determination of ITE signal magnitudes of the ITE audio sound signal at a plurality of frequencies, and determination of BTE signal magnitudes of the BTE audio sound signal at the plurality of frequencies; and a gain processor configured for determining gain values at respective frequencies of the plurality of frequencies based on the ITE signal magnitudes and the BTE signal magnitudes.

12 Claims, 8 Drawing Sheets

(56) References Cited

U.S. PATENT DOCUMENTS

| | | | |
|---|---|---|---|
| 2001/0002930 | A1 | 6/2001 | Kates |
| 2004/0136541 | A1 | 7/2004 | Hamacher et al. |
| 2007/0183603 | A1 | 8/2007 | Jin et al. |
| 2009/0067651 | A1 | 3/2009 | Klinkby et al. |
| 2009/0097681 | A1 | 4/2009 | Puria et al. |
| 2009/0202091 | A1 | 8/2009 | Pedersen et al. |
| 2009/0262964 | A1 | 10/2009 | Havenith et al. |
| 2010/0092016 | A1 | 4/2010 | Iwano et al. |
| 2010/0303267 | A1 | 12/2010 | Pedersen et al. |
| 2012/0308019 | A1 | 12/2012 | Edwards |
| 2012/0308057 | A1 | 12/2012 | Edwards et al. |
| 2013/0064403 | A1 | 3/2013 | Hasler et al. |

FOREIGN PATENT DOCUMENTS

| | | | |
|---|---|---|---|
| EP | 2088802 | A1 | 8/2009 |
| EP | 2124483 | A2 | 11/2009 |
| EP | 2 391 145 | | 11/2011 |
| EP | 2 584 794 | A1 | 4/2013 |
| EP | 2 611 218 | | 7/2013 |
| WO | WO 0225996 | A1 | 3/2002 |
| WO | WO 2006/037156 | | 4/2006 |
| WO | WO 2006/042540 | | 4/2006 |
| WO | WO 2008/010716 | | 1/2008 |
| WO | WO 2009/049320 | | 4/2009 |
| WO | WO 2011/098153 | | 8/2011 |

OTHER PUBLICATIONS

Extended European Search Report dated Aug. 9, 2013 for EP Patent Application No. 13168718.8.
Second Technical Examination—Intention to Grant dated Apr. 22, 2014 for related DK Patent Application No. PA 2012 70832, 2 pages.
Extended European Search Report dated Jun. 21, 2012 for EP Patent App. No. 11196089.4.
First Office Action dated Jun. 20, 2012 for DK Patent App. No. PA 2011 70759.
Second Technical Examination, Intention to Grant dated Jan. 18, 2013 for DK Patent App. No. PA 2011 70759.
Notice of Allowance & Fees Due dated Apr. 16, 2013 for U.S. Appl. No. 13/352,133.
Extended European Search Report dated May 2, 2013 for EP Patent App. No. 12197705.2.
Extended European Search Report dated Jun. 5, 2013 for EP Patent App. No. 12199761.3.
Extended European Search Report dated May 27, 2013 for EP Patent App. No. 12199744.9.
First Technical Examination and Search Report dated May 31, 2013 for DK Patent Application No. PA 2012 70833.
First Technical Examination and Search Report dated Jun. 4, 2013 for DK Patent Application No. PA 2012 70832.
First Technical Examination and Search Report dated Aug. 12, 2013 for DK Patent Application No. PA 2012 70836.
Extended European Search Report dated May 31, 2013 for EP Patent Application No. 12199720.9.
Notice of Allowance and Fees Due dated Sep. 16, 2013 for U.S. Appl. No. 13/352,133.
Notice of Reasons for Rejection dated Nov. 5, 2013 for related JP Patent Application No. 2012-281443, 4 pages.
Second Technical Examination and Intention to Grant dated Feb. 27, 2014 for DK Patent Application No. PA 2012 70836.
Non-final Office Action dated Sep. 11, 2014 for U.S. Appl. No. 13/872,590.
Non-Final Office Action dated Sep. 15, 2014 for U.S. Appl. No. 13/872,459.
First Technical Examination and Search Report dated Aug. 28, 2014, for related DK Patent Application No. PA 2014 70178, 6 pages.
Notification of Reason for Rejection dated Nov. 11, 2014 for related Japanese Patent Application No. 2013-266879, 4 pages.
Extended European Search Report dated Jan. 20, 2015 for related EP Patent Application No. 14163573.0, 8 pages.
Non-final Office Action dated Jan. 5, 2015 for U.S. Appl. No. 13/872,720.
Notice of Allowance and Fees Due dated Feb. 4, 2015 for U.S. Appl. No. 13/872,459.
Notice of Allowance and Fees Due Feb. 3, 2015 for U.S. Appl. No. 13/872,590.
Notice of Allowance and Fees Due dated Apr. 15, 2015 for U.S. Appl. No. 13/872,459.
Notice of Allowance and Fees Due dated Apr. 28, 2015 for U.S. Appl. No. 13/872,590.
Second Technical Examination dated Mar. 20, 2015 for related Danish Patent Application No. PA 2014 70178, 3 pages.
Third Technical Examination dated Apr. 17, 2015 for related Danish Patent Application No. PA 2014 70178, 2 pages.
Fourth Technical Examination—Intention to Grant dated May 18, 2015 for related Danish Patent Application No. PA 2014 70178, 2 pages.

HEARING AID WITH IMPROVED LOCALIZATION

RELATED APPLICATION DATA

This application claims priority to and the benefit of Danish Patent Application No. PA 2013 70273, filed on May 22, 2013, and European Patent Application No. 13168718.8, filed on May 22, 2013. The entire disclosures of both of the above applications are expressly incorporated by reference herein.

FIELD OF TECHNOLOGY

A new hearing aid is provided with improved localization of sound sources with relation to the wearer of the hearing aid.

BACKGROUND

Hearing aid users have been reported to have poorer ability to localize sound sources when wearing their hearing aids than without their hearing aids. This represents a serious problem for the mild-to-moderate hearing impaired population.

Furthermore, hearing aids typically reproduce sound in such a way that the user perceives sound sources to be localized inside the head. The sound is said to be internalized rather than being externalized. A common complaint for hearing aid users when referring to the "hearing speech in noise problem" is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid (s).

Thus, there is a need for a new hearing aid with improved localization of sound sources, i.e. the new hearing aid preserves information of the directions and distances of respective sound sources in the sound environment with relation to the orientation of the head of the wearer of the hearing aid.

Human beings detect and localize sound sources in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system will not be able to distinguish the reproduced sound from the actual sound generated by the spatial sound field itself.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The transmission of a sound wave from a sound source positioned at a given direction and distance in relation to the left and right ears of the listener is described in terms of two transfer functions, one for the left ear and one for the right ear, that include any linear transformation, such as coloration, interaural time differences and interaural spectral differences. Such a set of two transfer functions, one for the left ear and one for the right ear, is called a Head-Related Transfer Function (HRTF). Each transfer function of the HRTF is defined as the ratio between a sound pressure p generated by a plane wave at a specific point in or close to the appertaining ear canal ($p_L$) in the left ear canal and $p_R$ in the right ear canal) in relation to a reference. The reference traditionally chosen is the sound pressure $p_I$ that would have been generated by a plane wave at a position right in the middle of the head with the listener absent.

The HRTF contains all information relating to the sound transmission to the ears of the listener, including diffraction around the head, reflections from shoulders, reflections in the ear canal, etc., and therefore, the HRTF varies from individual to individual.

In the following, one of the transfer functions of the HRTF will also be termed the HRTF for convenience.

The hearing aid related transfer function is defined similar to a HRTF, namely as the ratio between a sound pressure p generated by the hearing aid at a specific point in the appertaining ear canal in response to a plane wave and a reference. The reference traditionally chosen is the sound pressure $p_I$ that would have been generated by a plane wave at a position right in the middle of the head with the listener absent.

The HRTF changes with direction and distance of the sound source in relation to the ears of the listener. It is possible to measure the HRTF for any direction and distance and simulate the HRTF, e.g. electronically, e.g. by filters. If such filters are inserted in the signal path between a playback unit, such as a tape recorder, and headphones used by a listener, the listener will achieve the perception that the sounds generated by the headphones originate from a sound source positioned at the distance and in the direction as defined by the transfer functions of the filters simulating the HRTF in question, because of the true reproduction of the sound pressures in the ears.

Binaural processing by the brain, when interpreting the spatially encoded information, results in several positive effects, namely better signal-to-noise ratio (SNR); direction of arrival (DOA) estimation; depth/distance perception and synergy between the visual and auditory systems.

The complex shape of the ear is a major contributor to the individual spatial-spectral cues (ITD, ILD and spectral cues) of a listener. Devices which pick up sound behind the ear will, hence, be at a disadvantage in reproducing the HRTF since much of the spectral detail will be lost or heavily distorted.

This is exemplified in FIGS. 1 and 2 where the angular frequency spectrum of an open ear, i.e. non-occluded, measurement is shown in FIG. 1 for comparison with FIG. 2 showing the corresponding measurement on the front microphone on a behind the ear device (BTE) using the same ear. The open ear spectrum shown in FIG. 1 is rich in detail whereas the BTE result shown in FIG. 2 is much more blurred and much of the spectral detail is lost.

SUMMARY

It is therefore desirable to position one or more microphones of the hearing aid at position(s) with relation to a user wearing the hearing aid in which spatial cues of sounds arriving at the user is preserved. It is for example advantageous to position a microphone in the outer ear of the user in front of the pinna, i.e. opposite behind the pinna where microphones of a conventional BTE hearing aid are positioned; for example at the entrance to the ear canal; or, inside the ear canal, in order to preserve spatial cues of sounds arriving at the ear to a much larger extent than what is possible with a microphone positioned behind the pinna. A position below the triangular fossa has also proven advantageous with relation to preservation of spatial cues.

Positioning of a microphone at the entrance to the ear canal or inside the ear canal leads to the problem that the microphone is located close to the sound emitting device of the hearing aid, whereby the risk of feedback generation is increased, which in turn limits the maximum stable gain which can be prescribed with the hearing aid.

The standard way of solving this problem is to completely seal off the ear canal using a custom mould. This, however, introduces the occlusion effect as well as comfort issues with respect to moisture and heat.

For comparison, the maximum stable gain of a BTE hearing aid with front and rear microphones positioned behind the ear, and an In-The-Ear (ITE) hearing aid with an open fitted microphone positioned in the ear canal is shown in FIG. 3. It can be seen that the ITE hearing aid has much lower maximum stable gain (MSG) than the front and rear BTE microphones for nearly all frequencies.

In the new hearing aid, output signals of an arbitrary configuration of microphones and possibly other types of input sound transducers, such as transducers for implantable hearing aids, telecoils, receivers of digital audio datastreams, etc, undergo signal processing in such a way that spatial cues are preserved and conveyed to the user of the hearing aid. The microphone and possible other transducer output signals are filtered with filters that are configured to preserve spatial cues.

The new hearing aid provides improved localization to the user by providing, in addition to conventionally positioned microphones as in a BTE hearing aid, at least one ITE microphone intended to be positioned in the outer ear of the user in front of the pinna, i.e. not behind the pinna like the microphone(s) conventionally accommodated in a BTE hearing aid housing, e.g. at the entrance to the ear canal or immediately below the triangular fossa; or, inside the ear canal, when in use, in order to receive sound arriving at the ear of the user and containing the desired spatial information relating to localization of sound sources in the sound environment.

The circuitry of the new hearing aid combines an audio sound signal of the at least one ITE microphone residing in front of the pinna with audio sound signals of other sound input transducer(s) in such a way that spatial cues are preserved.

Thus, a hearing aid is provided, comprising a BTE hearing aid housing configured to be worn behind the pinna of a user and accommodating at least one BTE sound input transducer, such as an omnidirectional microphone, a directional microphone, a transducer for an implantable hearing aid, a telecoil, a receiver of a digital audio datastream, etc., configured for conversion of acoustic sound into a BTE audio sound signal, an ITE microphone housing configured to be positioned in the outer ear of the user and accommodating at least one ITE microphone configured for conversion of acoustic sound into an ITE audio sound signal, a signal detector configured for determination of an ITE signal magnitude of the ITE audio sound signal at a plurality of frequencies, and determination of a BTE signal magnitude of the BTE audio sound signal at the plurality of frequencies, a gain processor for determination of gain values at respective frequencies of the plurality of frequencies based on the determined respective ITE signal magnitude and BTE signal magnitude.

Further, the hearing aid may comprise a multiplier configured for multiplying the BTE audio sound signal with the determined gain values at the respective frequencies.

Preferably, the hearing aid also comprises a processor configured to generate a hearing loss compensated output signal based on the multiplied BTE audio sound signal, and an output transducer for conversion of the hearing loss compensated output signal to an auditory output signal, such as an acoustic output signal, an implanted transducer signal, etc, that can be received by the human auditory system.

The ITE audio sound signal may be formed as a weighted sum of the output signals of each microphone of the at least one ITE microphone. Other forms of signal processing may be included in the formation of the ITE audio sound signal.

Likewise, the BTE audio sound signal may be formed as a weighted sum of the output signals of each sound input transducer of the at least one BTE sound input transducer. Other forms of signal processing may be included in the formation of the BTE audio sound signal.

Preferably, one microphone of the at least one BTE sound input transducer are located proximate a top part of the BTE hearing aid housing so that sound arriving from the frontal looking direction of the user of the hearing aid has an unobstructed propagation path towards the input of the microphone, when the BTE hearing aid housing is mounted in its intended operating position behind the pinna of the user. Possible other microphones of the at least one BTE sound input transducer are located proximate the one microphone so that the one or more microphones of the at least one BTE sound input transducer are accommodated in the upper part of the BTE hearing aid housing residing above a horizontal, tangential plane to the upper circumference of the entrance to the ear canal of the user, when the BTE hearing aid housing is mounted in its intended operating position behind the pinna of the user.

The hearing aid may further comprise a sound signal transmission member for transmission of a sound signal from a sound output in the BTE hearing aid housing at a first end of the sound signal transmission member to the ear canal of the user at a second end of the sound signal transmission member, an earpiece configured to be inserted in the ear canal of the user for fastening and retaining the sound signal transmission member in its intended position in the ear canal of the user.

Throughout the present disclosure, the "ITE audio sound signal" may be used to identify any analogue or digital signal forming part of the signal path from the combined output of the at least one ITE microphone to an input of the processor, including pre-processed ITE audio sound signals.

Likewise, the "BTE audio sound signal" may be used to identify any analogue or digital signal forming part of the signal path from the combined output of the at least one BTE sound input transducer to an input of the processor, including pre-processed BTE audio sound signals.

In use, the at least one ITE microphone is positioned so that the ITE audio sound signal generated in response to the incoming sound has a transfer function that constitutes a good approximation to the HRTFs of the user. For example, the at least one ITE microphone may be constituted by a single microphone positioned at the entrance to the ear canal. The hearing aid circuitry conveys the directional information contained in the ITE audio sound signal to the resulting hearing loss compensated output signal of the processor so that the hearing loss compensated output signal of the processor also attains a transfer function that constitutes a good approximation to the HRTFs of the user whereby improved localization is provided to the user.

BTE (behind-the-ear) hearings aids are well-known in the art. A BTE hearing aid has a BTE housing that is shaped to be worn behind the pinna of the user. The BTE housing accommodates components for hearing loss compensation. A sound signal transmission member, i.e. a sound tube or an electrical conductor, transmits a signal representing the hearing loss compensated sound from the BTE housing into the ear canal of the user.

In order to position the sound signal transmission member securely and comfortably at the entrance to the ear canal of the user, an earpiece, shell, or earmould may be provided for insertion into the ear canal of the user constituting an open solution. In an open solution, the earpiece, shell, or earmould does not obstruct the ear canal when it is positioned in its intended operational position in the ear canal. Rather, there will be a passageway through the earpiece, shell, or earmould or, between a part of the ear canal wall and a part of the earpiece, shell, or earmould, so that sound waves may escape from behind the earpiece, shell, or earmould between the ear drum and the earpiece, shell, or earmould through the passageway to the surroundings of the user. In this way, the occlusion effect is substantially eliminated.

Typically, the earpiece, shell, or earmould is individually custom manufactured or manufactured in a number of standard sizes to fit the user's ear to sufficiently secure the sound signal transmission member in its intended position in the ear canal and prevent the earpiece from falling out of the ear, e.g., when the user moves the jaw.

The output transducer may be a receiver positioned in the BTE hearing aid housing. In this event, the sound signal transmission member comprises a sound tube for propagation of acoustic sound signals from the receiver positioned in the BTE hearing aid housing and through the sound tube to an earpiece positioned and retained in the ear canal of the user and having an output port for transmission of the acoustic sound signal to the eardrum in the ear canal.

The output transducer may be a receiver positioned in the earpiece. In this event, the sound signal transmission member comprises electrical conductors for propagation of hearing loss compensated audio sound signals from the hearing aid circuitry in the BTE hearing aid housing through the conductors to a receiver positioned in the earpiece for emission of sound through an output port of the earpiece.

Further, a method is provided of preserving spatial cues in an audio sound signal to be converted into an auditory output signal, such as an acoustic output signal, an implanted transducer signal, etc, that can be received by the human auditory system, comprising the steps of converting acoustic sound into a first audio sound signal, mounting at least one microphone at an ear of a user for conversion of acoustic sound into a second audio sound signal in a position at the ear of the user in which spatial cues of the acoustic sound is preserved in the second acoustic sound signal, characterized in the steps of determining a first signal magnitude of the first audio sound signal at a plurality of frequencies, determining a second signal magnitude of the second audio sound signal at the plurality of frequencies, determining gain values at respective frequencies of the plurality of frequencies based on the determined first signal magnitude and second signal magnitude, and multiplying the first audio sound signal with the determined gain values at the respective frequencies.

Still further, a method is provided of suppressing feedback and preserving spatial cues in a hearing aid with at least one microphone with an operational position at an ear of a user wherein conversion of acoustic sound into a first audio sound signal preserves spatial cues of the acoustic sound in the first audio sound signal, comprising the steps of converting acoustic sound into the first audio sound signal utilizing the at least one microphone, mounting a BTE hearing aid housing accommodating at least one BTE sound input transducer in its operational position behind the pinna of the user, converting acoustic sound into a second audio sound signal utilizing the at least one BTE sound input transducer, determining a first signal magnitude of the first audio sound signal at a plurality of frequencies, determining a second signal magnitude of the second audio sound signal at the plurality of frequencies, determining gain values at respective frequencies of the plurality of frequencies based on the determined first signal magnitude and second signal magnitude, and multiplying the second audio sound signal with the determined gain values at the respective frequencies.

For both methods, a weighted sum of the first and second audio sound signals may be input to a hearing loss processor of the hearing aid, the weighted sum forming e.g. a compromise between preservation of spatial cues and suppression of possible feedback. For both methods, the weight of the audio signal containing spatial cues, e.g. as obtained by a microphone positioned at the entrance to the ear canal of the user, may be set to zero, whereby only the audio sound signal from the at least one BTE sound input transducer is amplified as a result of hearing loss compensation while the audio signal containing spatial cues is not included in the hearing loss compensation processing, whereby risk of feedback is reduced and a large maximum stable gain can be provided due to the relatively large distance between from the output transducer of the hearing aid and the at least one BTE sound input transducer. In this way, the audio sound signal containing spatial cues may operate as monitor signal imparting the desired spatial information of the current sound environment to the audio signal output by the at least one BTE sound input transducer.

Signal magnitude at the plurality of frequencies may be determined as absolute values of the Fourier transformed signal, or as rms-values, absolute values, amplitude values, etc., of the signal, appropriately bandpass filtered and averaged, etc.

For example, in a hearing aid with one or more microphones, typically two microphones, positioned in a BTE hearing aid housing as is well-known in the art of hearing aids, the audio sound signal(s) output by the individual microphone(s) are combined into the BTE audio sound signal that is processed in accordance with the new method so that spatial cues are preserved.

This is obtained by modifying the BTE audio sound signal in accordance with an ITE sound signal obtained from one or more microphones, typically one microphone, positioned in location(s) relative to the user of the hearing aid, wherein spatial cues of sound arriving at those locations are preserved, e.g. at the entrance to the ear canal, inside the ear canal, immediately below the triangular fossa, etc.

According to the new method, the BTE audio sound signal is processed so that differences in signal magnitudes between the BTE audio sound signal and the ITE audio sound signal are reduced. The processing may be performed in a selected frequency range, or in a plurality of selected frequency ranges, or in the entire frequency range in which the hearing aid circuitry is capable of operating.

For example, in the selected frequency range(s), spectrum analysis is performed whereby the absolute value B(f) as a function of frequency of the BTE audio sound signal and the absolute value A(f) as a function of frequency of the ITE audio sound signal are determined. Then, multiplier gain values G(f) as a function of frequency are determined G(f) =A(f)/B(f), and the multiplier with the determined gain values G(f) is inserted in the signal path of the BTE audio sound signal.

In general, determined gain values at the plurality of frequencies may be converted to corresponding filter coefficients of a linear phase filter inserted into the signal path of the BTE audio sound signal; or, the gain values may be applied directly to the BTE audio sound signal in the frequency domain.

In general, determined gain values may be compared to the respective maximum stable gain values at each of the plurality of frequencies, and gain values that are larger than the respective maximum stable gain values may be substituted by the respective maximum stable gain value, possibly minus a margin, to avoid risk of feedback.

It has been shown that the output signal of the multiplier, in the following denoted the gain modified BTE audio sound signal, has preserved spatial cues due to signal magnitude similarities with the ITE audio sound signal.

Subsequently, the gain modified BTE audio sound signal is input to a processor for hearing loss compensation.

In one example of the new hearing aid, only the BTE audio sound signal is amplified as a result of hearing loss compensation while the ITE audio sound signal is not included in the hearing loss compensation processing, whereby possible feedback from the output transducer to the at least one ITE microphone is reduced and a large maximum stable gain can be provided.

The at least one ITE microphone may operate as monitor microphone(s) for generation of an ITE audio sound signal with the desired spatial information of the current sound environment.

The new hearing aid may further have an adaptive feedback suppressor for feedback suppression and having an input connected to an output of the processor for reception of the hearing loss compensated output signal, at least one output modelling the feedback path from an output of the hearing aid to the respective at least one ITE microphone and at least one BTE sound input transducer and connected to at least one subtractor for subtraction of the respective at least one output of the adaptive feedback suppressor from the respective output of at least one ITE microphone and the at least one BTE sound transducer and outputting the respective difference signal as the respective ITE audio sound signal and BTE audio sound signal.

The hearing aid may further comprise a feedback monitor connected to the adaptive feedback suppressor and configured to monitor the state of feedback and having an output providing an indication of the state of feedback.

The gain processor may have an input that is connected to the output of the feedback monitor and may be configured to modify, in response to the output signal of the feedback monitor, the calculated gain values as a function of frequency in such a way that risk of feedback is reduced, e.g. by lowering the determined gain values at selected frequencies with risk of feedback.

Feedback may be taken into account by monitoring feedback stability status and modifying gain value determination in response to the feedback stability status. When no feedback is detected, the gain processor operates to reduce differences in signal magnitudes of the BTE and ITE audio sound signals as explained above.

In the event that the feedback stability status changes towards instability, the determination of gain values in the gain processor may be modified in order to avoid feedback, e.g. the determined gain value may be lowered in one or more frequency ranges with risk of feedback.

When feedback stability status reverts to a stable condition, gain value determination based solely on the ITE and BTE audio sound signals may be resumed. The reduced gain values may be changed gradually towards the determined gain values with no risk of feedback.

The ITE microphone housing accommodating at least one ITE microphone may be combined with, or be constituted by, the earpiece so that the at least one microphone is positioned proximate the entrance to the ear canal when the earpiece is fastened in its intended position in the ear canal.

The ITE microphone housing may be connected to the BTE hearing aid housing with an arm, possibly a flexible arm that is intended to be positioned inside the pinna, e.g. around the circumference of the conchae abutting the antihelix and at least partly covered by the antihelix for retaining its position inside the outer ear of the user. The arm may be pre-formed during manufacture, preferably into an arched shape with a curvature slightly larger than the curvature of the antihelix, for easy fitting of the arm into its intended position in the pinna. In one example, the arm has a length and a shape that facilitate positioning of the at least one ITE microphone in an operating position immediately below the triangular fossa.

The processor may be accommodated in the BTE hearing aid housing, or in the ear piece, or part of the processor may be accommodated in the BTE hearing aid housing and part of the processor may be accommodated in the ear piece. There is a one-way or two-way communication link between circuitry of the BTE hearing aid housing and circuitry of the earpiece. The link may be wired or wireless.

Likewise, there is a one-way or two-way communication link between circuitry of the BTE hearing aid housing and the microphone housing. The link may be wired or wireless.

The hearing aid circuitry operates to perform hearing loss compensation while maintaining spatial information of the sound environment for optimum spatial performance of the hearing aid and while at the same time providing as large maximum stable gain as possible.

The ITE audio sound signal output by the earpiece may be a combination of several pre-processed ITE microphone signals, or the output signal of a single ITE microphone of the at least one ITE microphone. The short time spectrum for a given time instance of the ITE audio sound signal of the earpiece is denoted $S^{IEC}(f,t)$ (IEC=In the Ear Component).

One or more output signals of the at least one BTE sound input transducers are provided. The spectra of these signals are denoted $S_1^{BTEC}(f,t)$, and $S_2^{BTEC}(f,t)$, etc (BTEC=Behind The Ear Component). The output signals may be pre-processed. Pre-processing may include, without excluding any form of processing; adaptive and/or static feedback suppression, adaptive or fixed beamforming and pre-filtering.

The multiplier may be configured to adaptively modify the BTE audio sound signal to correspond to the ITE audio sound signal as closely as possible.

The hearing aid may comprise a signal combiner configured for combination of the ITE audio sound signal with the gain modified BTE audio sound signal and having an output connected to the processor input for hearing loss compensation. The signal combiner may output a weighted sum of the ITE and BTE audio sound signals. In selected frequency bands with no risk of feedback, the signal combiner may pass the ITE audio sound signal (ITE weight=1 and BTE weight=0), i.e. the ITE audio sound signal may constitute the input signal, or the main part of the input signal, supplied to the processor input. In frequency bands with risk of feedback, the signal combiner may pass the BTE audio sound signal (ITE weight=0 and BTE weight=1), i.e. the BTE audio sound signal may constitute the input signal, or the main part of the input signal, supplied to the processor input, while a weighted sum of the BTE and ITE audio sound signals may constitute the main part of the input signal supplied to the processor input in complementary frequency band(s).

In this way, the at least one ITE microphone may be used as the sole input source to the processor in a frequency band wherein the required gain for hearing loss compensation can be applied to the ITE audio sound signal without feedback. Outside this frequency band, the BTE audio sound signal is applied to the processor for provision of the required gain. In yet other frequency bands, the signal combiner may supply a weighted sum of the BTE audio sound signal and the ITE audio sound signal to the processor, the weighted sum forming a compromise between preservation of spatial cues and suppression of possible feedback.

The combination of the signals could e.g. be based on different types of band pass filtering.

The hearing aid may be a multi-channel hearing aid in which signals to be processed are divided into a plurality of frequency channels, and wherein signals are processed individually in each of the frequency channels. The adaptive feedback suppression circuitry may also be divided into the plurality of frequency channels; or, the adaptive feedback suppression circuitry may still operate in the entire frequency range; or, may be divided into other frequency channels, typically fewer frequency channels, than the other circuitry is divided into.

The processor may be configured for processing the ITE and BTE audio sound signals in such a way that the hearing loss compensated output signal substantially preserves spatial cues in a selected frequency band.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the at least one ITE microphone may be connected conventionally as an input source to the processor of the hearing aid and may cooperate with the hearing aid circuitry in a well-known way.

In this way, the at least one ITE microphone supplies the input to the hearing aid at frequencies where the hearing aid is capable of supplying the desired gain with this configuration. In frequency band(s), wherein the hearing aid cannot supply the desired gain with this configuration, the microphones of BTE hearing aid housing are included in the signal processing as disclosed above. In this way, the gain can be increased while simultaneously conveying the spatial information about the sound environment provided by the at least one ITE microphone to the user.

Signal processing in the new hearing aid may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

A hearing aid includes: a BTE hearing aid housing configured to be worn behind a pinna of a user and accommodating at least one BTE sound input transducer configured for conversion of acoustic sound into a BTE audio sound signal; an ITE microphone housing configured to be positioned in an outer ear of the user and accommodating at least one ITE microphone configured for conversion of acoustic sound into an ITE audio sound signal and accommodated by the ITE microphone housing; a signal detector configured for determination of ITE signal magnitudes of the ITE audio sound signal at a plurality of frequencies, and determination of BTE signal magnitudes of the BTE audio sound signal at the plurality of frequencies; and a gain processor configured for determining gain values at respective frequencies of the plurality of frequencies based on the ITE signal magnitudes and the BTE signal magnitudes.

Optionally, the hearing aid further includes a multiplier configured for multiplying the BTE audio sound signal with the gain values at the respective frequencies to obtain a gain modified BTE audio sound signal.

Optionally, the hearing aid further includes a signal combiner configured for combining the ITE audio sound signal with the gain modified BTE audio sound signal.

Optionally, the signal combiner is configured for outputting a weighted sum of the ITE audio sound signal and the gain modified BTE audio sound signal.

Optionally, the hearing aid further includes an adaptive feedback suppressor for feedback suppression, wherein the adaptive feedback suppressor comprises an input connected for reception of a hearing loss compensated output signal, and is configured to provide a first output and a second output modelling a feedback path aid to the respective at least one ITE microphone and the at least one BTE sound input transducer; wherein the adaptive feedback suppressor is connected to at least one subtractor for subtraction of the respective first and second output of the adaptive feedback suppressor from respective output of at least one ITE microphone and the at least one BTE sound input transducer to provide respective difference signals, the at least one subtractor configured for outputting the respective difference signals as the respective ITE audio sound signal and BTE audio sound signal.

Optionally, the hearing aid further includes a feedback monitor connected to the adaptive feedback suppressor and configured to monitor a state of feedback, the feedback monitor having an output providing an indication of the state of the feedback; wherein the gain processor further has an input that is connected to the feedback monitor, and wherein the gain processor is configured for determination of the gain values at the respective plurality of frequencies based on the ITE signal magnitudes, BTE signal magnitudes and the state of the feedback.

Optionally, the hearing aid further includes a signal combiner, wherein the signal combiner has an input that is connected to the feedback monitor, and wherein the signal combiner is configured for combining the ITE audio sound signal with the BTE audio sound signal in response to the state of the feedback.

Optionally, the gain processor is configured for limiting the gain values so that a resulting gain of the hearing aid is kept below a maximum stable gain at the plurality of frequencies.

Optionally, the ITE audio sound signal and the BTE audio sound signal are divided into a plurality of frequency channels, and wherein the signal detector is configured for individually processing the ITE audio sound signal and the BTE audio sound signal at the plurality of frequencies that correspond to respective ones of the plurality of frequency channels.

Optionally, the ITE audio sound signal and the BTE audio sound signal are divided into a plurality of frequency channels; and wherein the signal combiner is configured for forming individual weighted sums of the ITE audio sound signal and the gain modified BTE audio sound signal in at least some of the frequency channels.

Optionally, the ITE audio sound signal and the BTE audio sound signal are divided into a plurality of frequency channels; and wherein the at least one BTE sound input transducer is disconnected in a selected frequency channel of the plurality of frequency channels so that hearing loss compensation is based solely on the ITE audio sound signal in the selected frequency channel.

A method of preserving spatial cues in an audio sound signal includes: converting acoustic sound into a first audio sound signal; converting acoustic sound into a second audio sound signal using at least one microphone at an ear of a user, wherein spatial cues of the acoustic sound being converted into the second audio sound signal is preserved in the second audio sound signal; determining a first set of signal magnitudes of the first audio sound signal at a plurality of frequencies; determining a second set of signal magnitudes of the second audio sound signal at the plurality of frequencies; determining gain values at respective frequencies of the plurality of frequencies based on the first set of signal magnitudes and the second set of signal magnitudes; and multiplying the first audio sound signal with the determined gain values at the respective frequencies.

A method of suppressing feedback and preserving spatial cues in a hearing aid with at least one microphone with an operational position at an ear of a user, includes: converting acoustic sound into a first audio sound signal utilizing the at least one microphone, wherein the act of converting the acoustic sound into the first audio sound signal preserves spatial cues of the acoustic sound in the first audio sound signal; converting acoustic sound into a second audio sound signal utilizing at least one BTE sound input transducer located behind a pinna of a user; determining a first set of signal magnitudes of the first audio sound signal at a plurality of frequencies; determining a second set of signal magnitudes of the second audio sound signal at the plurality of frequencies; determining gain values at respective frequencies of the plurality of frequencies based on the first set of signal magnitudes and the second set of signal magnitudes; and multiplying the second audio sound signal with the determined gain values at the respective frequencies.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting to the scope of the claims.

DETAILED DESCRIPTION

Figure 1:
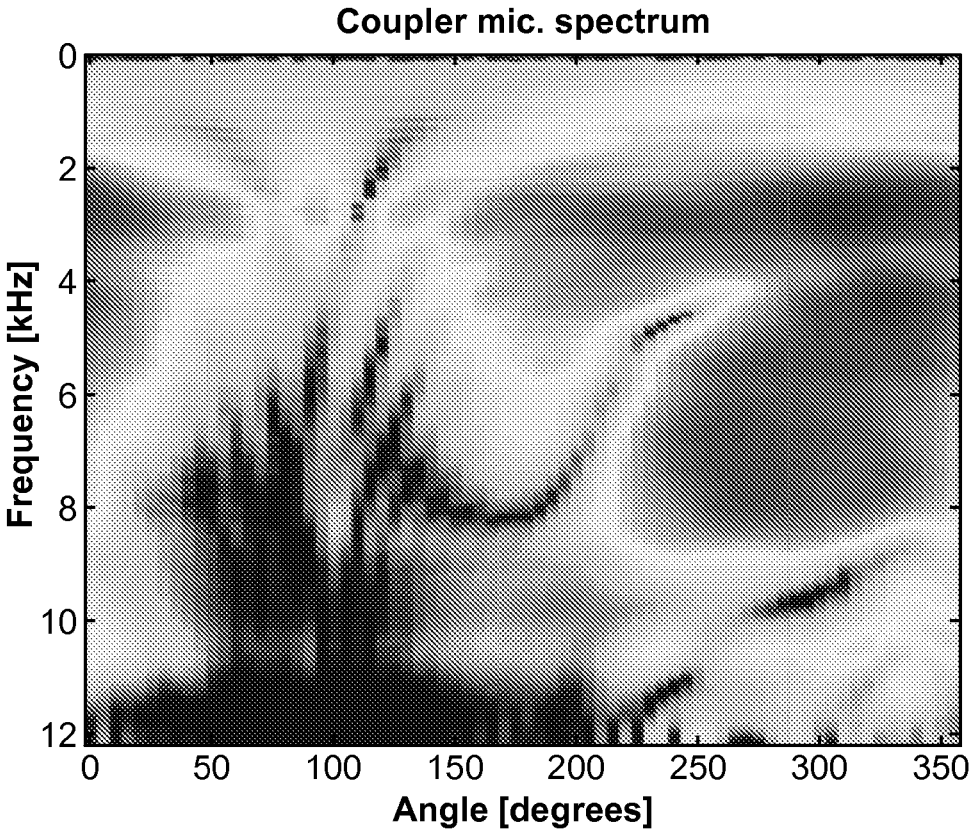
FIG. 1 shows a plot of the angular frequency spectrum of an open ear.
Figure 2:
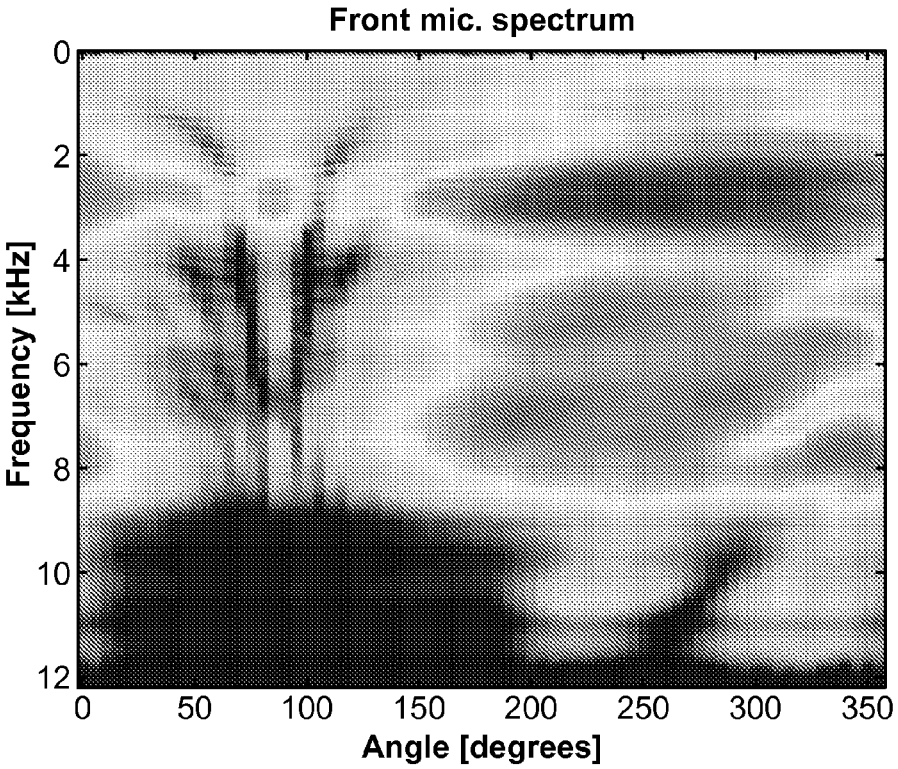
FIG. 2 shows a plot of the angular frequency spectrum of a BTE front microphone worn at the same ear.
Figure 3:
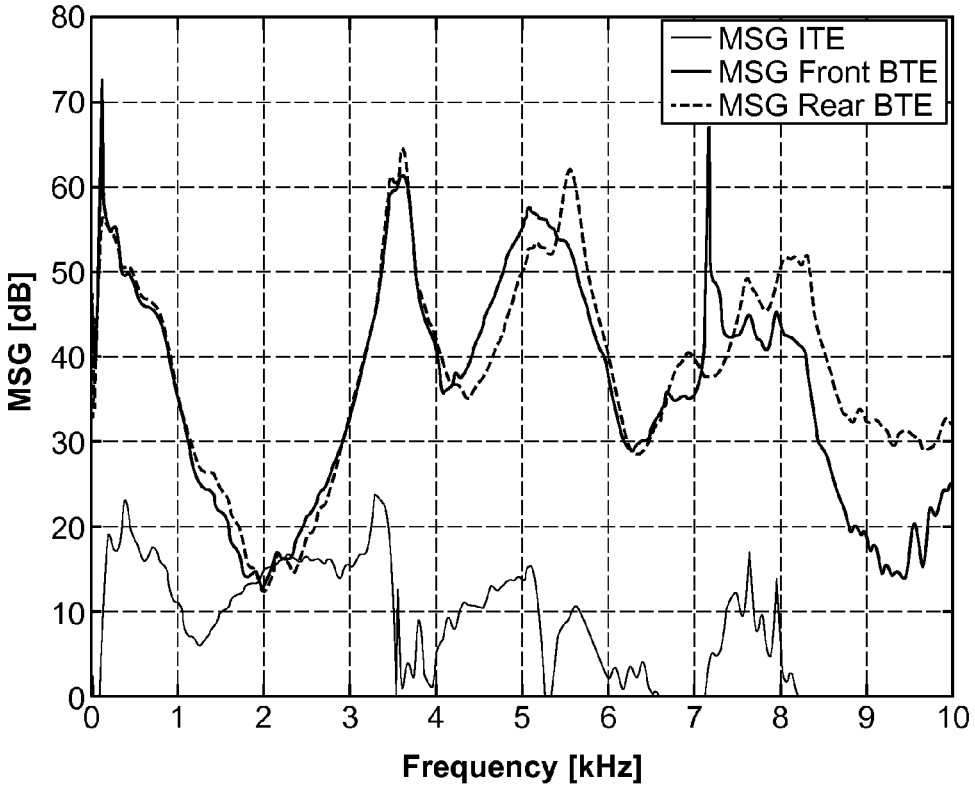
FIG. 3 shows plots of maximum stable gain of a BTE front and rear microphones and an open fitted ITE microphone positioned in the ear canal, FIG. 4 schematically illustrates an exemplary new hearing aid, FIG. 5 schematically illustrates another exemplary new hearing aid.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described The new method and hearing aid will now be described more fully hereinafter with reference to the accompanying drawings, in which various examples of the new method and hearing aid are illustrated. The new method and hearing aid according to the appended claims may, however, be embodied in different forms and should not be construed as limited to the examples set forth herein.

It should be noted that the accompanying drawings are schematic and simplified for clarity, and they merely show details which are essential to the understanding of the new method and hearing aid, while other details have been left out.

Like reference numerals refer to like elements throughout. Like elements will, thus, not be described in detail with respect to the description of each figure.

Figure 4:
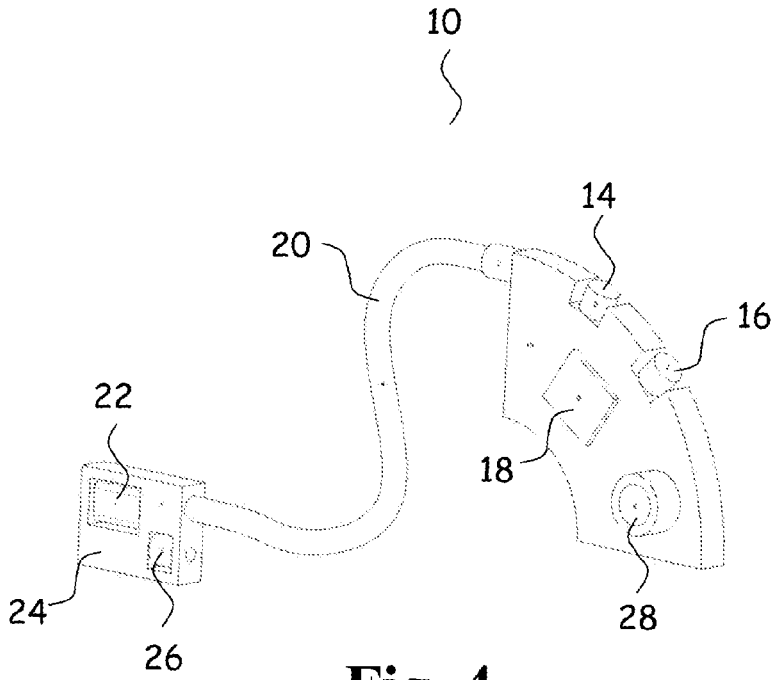

FIG. 4 schematically illustrates a BTE hearing aid 10 comprising a BTE hearing aid housing 12 (not shown—outer walls have been removed to make internal parts visible) to be worn behind the pinna 100 of a user. The BTE housing 12 accommodates at least one BTE sound input transducer 14, 16 with a front microphone 14 and a rear microphone 16 for conversion of a sound signal into a microphone audio sound signal, optional pre-filters (not shown) for filtering the respective microphone audio sound signals, A/D converters (not shown) for conversion of the respective microphone audio sound signals into respective digital microphone audio sound signals that are input to a processor 18 configured to generate a hearing loss compensated output signal based on the input digital audio sound signals.

The hearing loss compensated output signal is transmitted through electrical wires contained in a sound signal transmission member 20 to a receiver 22 for conversion of the hearing loss compensated output signal to an acoustic output signal for transmission towards the eardrum of a user and contained in an earpiece 24 that is shaped (not shown) to be comfortably positioned in the ear canal of a user for fastening and retaining the sound signal transmission member in its intended position in the ear canal of the user as is well-known in the art of BTE hearing aids.

The earpiece 24 also holds one ITE microphone 26 that is positioned at the entrance to the ear canal when the earpiece is positioned in its intended position in the ear canal of the user. The ITE microphone 26 is connected to an A/D converter (not shown) and optional to a pre-filter (not shown) in the BTE housing 12, with interconnecting electrical wires (not visible) contained in the sound transmission member 20.

The BTE hearing aid 10 is powered by battery 28.

Various functions of the processor 18 are disclosed above and in more detail below.

Figure 5:
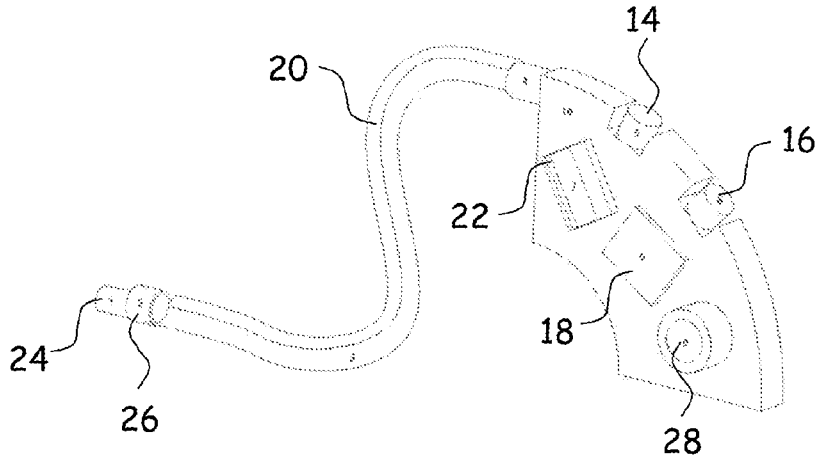

FIG. 5 schematically illustrates another BTE hearing aid 10 similar to the hearing aid shown in FIG. 1, except for the fact that in FIG. 5, the receiver 22 is positioned in the hearing aid housing 12 and not in the earpiece 24, so that acoustic sound output by the receiver 22 is transmitted through the sound tube 20 and towards the eardrum of the user when the earpiece 24 is positioned in its intended position in the ear canal of the user.

The positioning of the ITE microphone 26 proximate the entrance to the ear canal of the user when the BTE hearing aids 10 of FIGS. 4 and 5 are used is believed to lead to a good reproduction of the HRTFs of the user.

Figure 6:
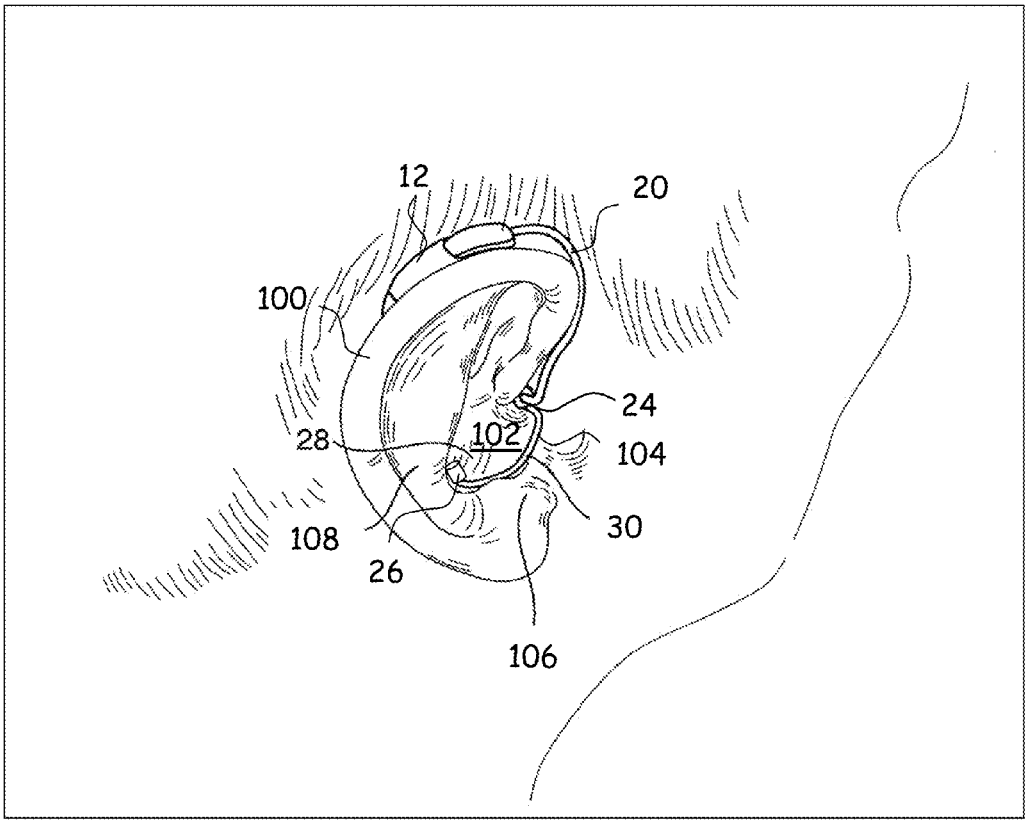
FIG. 6 shows in perspective a new hearing aid with an ITE-microphone in the outer ear of a user.

FIG. 6 shows a new hearing aid 10 in its operating position with the BTE housing 12 behind the ear, i.e. behind the pinna 100, of the user. The illustrated new hearing aid 10 is similar to the hearing aids shown in FIGS. 4 and 5 except for the fact that the ITE microphone 26 is positioned in the outer ear of the user outside the ear canal at the free end of an arm 30. The arm 30 is flexible and intended to be positioned inside the pinna 100, e.g. around the circumference of the conchae 102 behind the tragus 104 and antitragus 106 and abutting the antihelix 108 and at least partly covered by the antihelix for retaining its position inside the outer ear of the user. The arm may be pre-formed during manufacture, preferably into an arched shape with a curvature slightly larger than the curvature of the antihelix 104, for easy fitting of the arm 30 into its intended position in the pinna. The arm 30 contains electrical wires (not visible) for interconnection of the ITE microphone 26 with other parts of the BTE hearing aid circuitry.

In one example, the arm 30 has a length and a shape that facilitate positioning of the ITE microphone 26 in an operating position below the triangular fossa.

Figure 7:
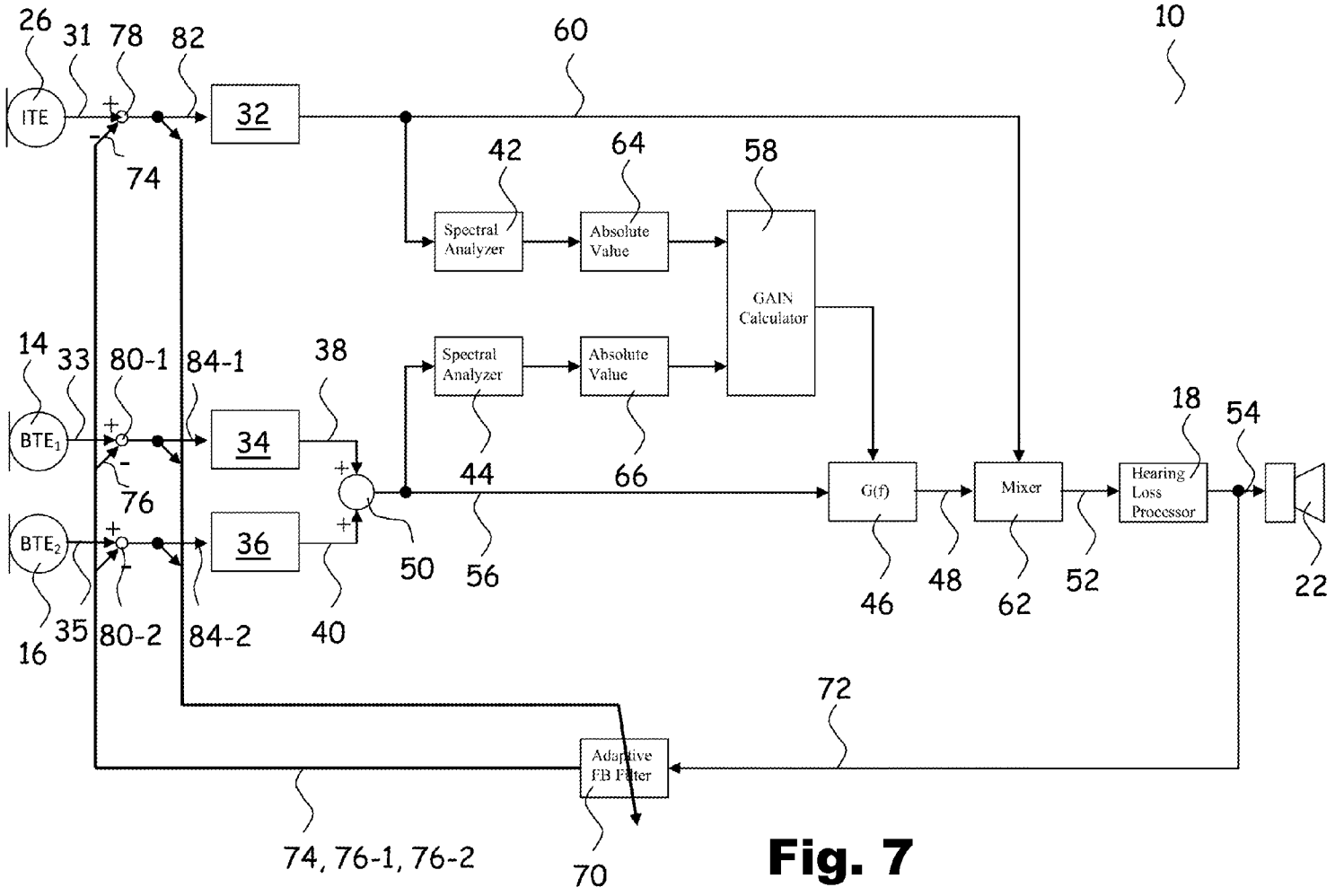
FIG. 7 shows a schematic block diagram of an exemplary new hearing aid with improved localization.

FIG. 7 is a block diagram illustrating one exemplary signal processing in the new hearing aid 10. The illustrated hearing aid 10 has a front microphone 14 and a rear microphone 16 accommodated in the BTE hearing aid housing 12 configured to be worn behind the pinna of the user and for conversion of sound signals arriving at the microphones 14, 16 into respective audio sound signals 33, 35. Further, the illustrated hearing aid 10 has an ITE microphone 26 accommodated in an earpiece (not shown) to be positioned in the outer ear of the user, for conversion of sound signals arriving at the microphone 26 into ITE audio sound signal 31.

The microphone audio sound signals 31, 33, 35 are digitized and pre-processed, such as pre-filtered, in respective pre-processors 32, 34, 36.

The pre-processed audio sound signals 38, 40 of the front and rear microphones 14, 16 are combined with, e.g. added to, each other in BTE signal combiner 50, and the combined signal 56, i.e. the BTE audio sound signal 56, is input to multiplier 46 for multiplication with gain values that are determined so that the signal magnitude of the gain modified BTE audio sound signal 48 is identical to, or substantially identical to, the signal magnitude of the ITE audio sound signal 60, whereby spatial cues in the ITE audio sound signal 60 are preserved.

The signal detector 42 performs a spectral analysis of the ITE audio sound signal 60, and the signal magnitude detector 64 determines signal magnitudes of the ITE audio sound signal 60 at a plurality of frequencies.

Likewise, the signal detector 44 performs a spectral analysis of the BTE audio sound signal 56, and the signal magnitude detector 66 determines signal magnitudes of the BTE audio sound signal 56 at the plurality of frequencies.

The gain processor 58 calculates gain values at respective frequencies of the plurality of frequencies based on the determined ITE audio sound signal magnitude and BTE audio sound signal magnitude, and outputs the determined gain values to the multiplier 46 that is connected for multiplying the BTE audio sound signal 56 with the determined gain values at the respective frequencies.

The ITE microphone 26 is positioned in a location relative to the user of the hearing aid 10, wherein spatial cues of sound arriving at the location are preserved, e.g. at the entrance to the ear canal, inside the ear canal, immediately below the triangular fossa, etc.

The BTE audio sound signal 56 is processed so that differences in signal magnitudes between the BTE audio sound signal 56 and the ITE audio sound signal 60 are reduced. The processing may be performed in a selected frequency range, or in a plurality of selected frequency ranges, or in the entire frequency range in which the hearing aid circuitry is capable of operating.

The determined gain values at the plurality of frequencies may be converted to corresponding filter coefficients of a linear phase filter inserted into the signal path of the BTE audio sound signal 56; or, the gain values may be applied directly to the BTE audio sound signal 56 in the frequency domain.

The determined gain values may further be compared to the corresponding maximum stable gain at the respective frequencies and for gain values that are larger than the respective maximum stable gains, the gain values may be substituted with the respective maximum stable gains, possibly minus a margin, to avoid risk of feedback.

It has been shown that the output signal 48 of the multiplier 46 has preserved spatial cues due to signal magnitude similarities with the ITE audio sound signal 60.

The gain modified BTE audio sound signal 48 may be input to the processor 18 for hearing loss compensation so that the ITE audio sound signal 60 does not form a direct part of the input to the processor 18, whereby risk of feedback is minimized.

However, in the hearing aid 10 illustrated in FIG. 7, the hearing aid 10 further comprises a signal combiner 62 configured for combination of the ITE audio sound signal 60 with the gain modified BTE audio sound signal 48 and providing a combined output signal 52 connected to an input of the processor 18 for hearing loss compensation. The signal combiner 62 may output a weighted sum of the ITE and BTE audio sound signals 60, 48.

The signal combiner may process the ITE audio sound signal 60 and BTE audio sound signal 56 differently in different frequency bands. For example, in selected frequency bands with no risk of feedback, the signal combiner 62 may pass the ITE audio sound signal 60 to the input of the processor 18, i.e. the ITE audio sound signal 60 may constitute the input signal 52, or the main part of the input signal 52, supplied to the input of the processor 18 and may cooperate with the processor 18 of the hearing aid 10 in a well-known way for hearing loss compensation. In this way, the ITE microphone 26 may be used as the sole input source to the processor 18 in a frequency band wherein the required gain for hearing loss compensation can be applied to the output signal 60 of the ITE microphone 26 without feedback.

In frequency bands with risk of feedback, the signal combiner 62 may pass the gain modified BTE audio sound signal 48 to the input of the processor 18, i.e. the BTE audio sound signal 48 may constitute the input signal, or the main part of the input signal, supplied to the input of the processor 18 for provision of the required gain with minimum risk of feedback and preservation of spatial cues, at least to some extent, due to the multiplication of the BTE audio sound signal 56 in the multiplier 62.

In other frequency bands, the signal combiner 62 may supply a weighted sum of the BTE audio sound signal 48 and the ITE audio sound signal 60 to the processor 18, the weighted sum forming a compromise between preservation of spatial cues and suppression of possible feedback.

The combination of the signals 48, 60 could e.g. be based on different types of band pass filtering.

The output signal 52 of the signal combiner 62 is input to processor 18 for hearing loss compensation, e.g. in a compressor. The hearing loss compensated signal 54 is output to the receiver 22 that converts the signal 54 to an acoustic output signal for transmission towards the ear drum of the user.

The ITE microphone 26 operates as monitor microphone for generation of an audio sound signal 60 with the desired spatial information of the current sound environment due to its positioning in the outer ear of the user.

The new hearing aid circuitry shown in FIG. 7 may operate in the entire frequency range of the hearing aid 10.

In order to suppress feedback, the illustrated new hearing aid 10 also has adaptive feedback suppression circuitry, including an adaptive feedback filter 70 with an input 72 connected to the output of the hearing aid processor 18 and with individual outputs 74, 76-1, 76-2, each of which is connected to a respective subtractor 78, 80-1, 80-2 for subtraction of each output 74, 76-1, 76-2 from a respective microphone output 31, 33, 35 to provide a respective feedback compensated signal 82, 84-1, 84-2 as is well-known in the art. Each feedback compensated signal 82, 84-1, 84-2 is fed to the corresponding pre-processor 32, 34, 36, and also to the adaptive feedback filter 70 for control of the adaption of the adaptive feedback filter 70. The adaptive feedback filter outputs 74, 76-1, 76-2 provide signals that constitute approximations of corresponding feedback signals travelling from the output transducer 22 to the respective microphone 14, 16, 26 as is well-known in the art.

The hearing aid 10 shown in FIG. 7 may be a multi-channel hearing aid in which microphone audio sound signals 31, 33, 35 to be processed are divided into a plurality of frequency channels, and wherein signals are processed individually in each of the frequency channels, possibly apart from the adaptive feedback suppression circuitry 70, 72, 74, 76-1, 76-2, 78, 80-1, 80-2, 82, 84-1, 84-2, 86 that may still operate in the entire frequency range; or, may be divided into other frequency channels, typically fewer frequency channels than the remaining illustrated circuitry.

For a multi-channel hearing aid 10, FIG. 7 may illustrate the circuitry and signal processing in a single frequency channel, as mentioned above possibly apart from the adaptive feedback suppression circuitry that may be divided into different frequency channels.

The circuitry and signal processing may be duplicated in a plurality of the frequency channels, e.g. in all of the frequency channels.

For example, the signal processing illustrated in FIG. 7 may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the ITE microphone 26 may be connected conventionally as an input source to the processor 18 of the hearing aid 10 and may cooperate with the processor 18 of the hearing aid 10 in a well-known way.

In this way, the ITE microphone 26 supplies the input to the hearing aid at frequencies where the hearing aid is capable of supplying the desired gain with this configuration. In the selected frequency band, wherein the hearing aid cannot supply the desired gain with this configuration, the microphones 14, 16 of BTE hearing aid housing are included in the signal processing as disclosed above. In this way, the gain can be increased while the spatial information of the sound environment as provided by the ITE microphone is simultaneously maintained.

An arbitrary number N of ITE microphones may substitute the ITE microphone 26, and a combination of output signals from the N ITE microphones may be combined in a ITE signal combiner to form the ITE audio sound signal 60, e.g. as a weighted sum. The weights may be frequency dependent.

Likewise, an arbitrary number M of BTE microphones may substitute the BTE microphones 14, 16, and a combination of output signals from the M BTE microphones may be combined in a BTE signal combiner to form the BTE audio sound signal 56, e.g. as a weighted sum. The weights may be frequency dependent.

Figure 8:
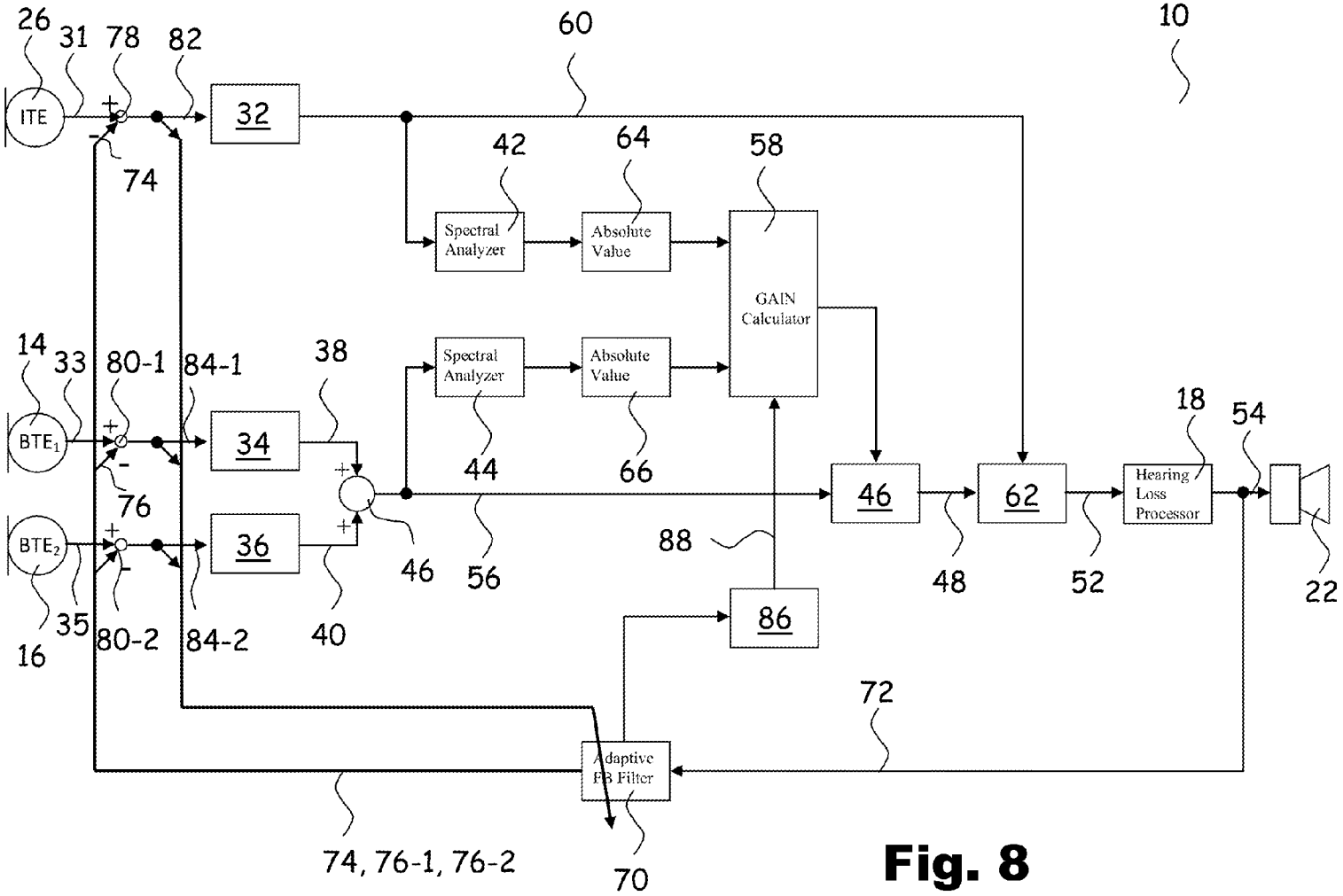
FIG. 8 shows a schematic block diagram of the hearing aid of FIG. 7 with added monitoring of feedback suppression.

FIG. 8 is a block diagram illustrating the same hearing aid 10 as in FIG. 7 and operating in the same way, except for the fact that a feedback monitor 86 has been added that is configured for monitoring the state of the adaptive feedback filter 70, e.g. in order to detect emerging feedback. The feedback monitor 86 provides a feedback monitor signal 88 accordingly. The gain processor 58 receives the monitor signal 88 and modifies its gain value calculation in response to the value of the monitor signal 88, i.e. in response to the state of feedback.

When no emerging feedback is detected, the gain value calculation is performed as explained above.

In the event that state of feedback changes towards instability, e.g. emerging feedback is detected, the determined gain value may be lowered to reduce risk of feedback, e.g. in the entire frequency range in which the hearing aid circuitry is capable of operating, or, in a selected frequency band in which the feedback is otherwise expected to emerge.

When feedback stability status reverts to a stable condition, gain value calculation as explained above, is resumed.

The lowered gain values may be changed gradually towards the gain values determined by the gain processor 58 without risk of feedback.

For example, the gain values may be changed gradually according to:

$$w=(1-\beta)*\text{gain}_{reduced}+\beta*\text{gain}_{not\ reduced}$$

wherein $\text{gain}_{reduced}$ is the lowered gain value of the multiplier, $\text{gain}_{not\ reduced}$ is the gain value as determined by the gain processor 58 with no risk of feedback. β may be a function (between 0 and 1) of state of feedback. If β is 0, feedback problem is very severe and low gain values are used to ensure stability. If β is 1, feedback is not a problem at all and the gain processor operates as explained above.

An example of calculation of β is given by $$\beta = \min\left(\frac{\|\hat{H}_{FB} - \overline{H}_{FB}\|_2^2}{\|\overline{H}_{FB}\|_2^2}, 1\right)$$

where $\hat{H}_{FB}$ is the estimated feedback path response, e.g. from the output transducer 22 to the ITE audio sound signal 60 as modeled by adaptive feedback suppressor 70, and $\overline{H}_{FB}$ is a stable feedback path response, e.g. determined during start-up of the hearing aid.

Figure 9:
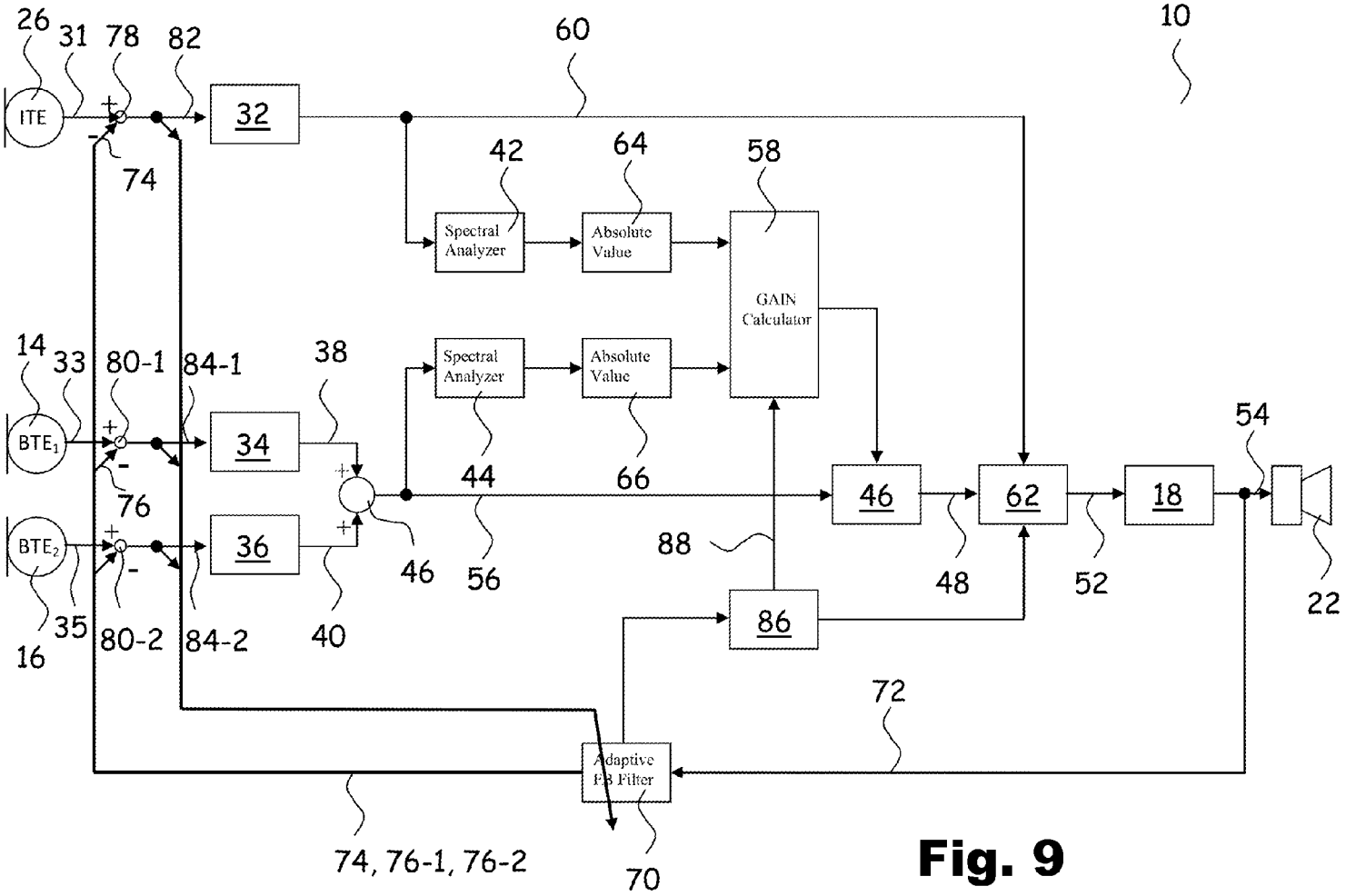
FIG. 9 shows a schematic block diagram of the hearing aid of FIG. 8 with added adaptiveness of the signal combiner.

The hearing aid 10 shown in FIG. 9 is similar to the hearing aid 10 shown in FIG. 8 and operates in the same way, apart from the fact that, in FIG. 9, the signal combiner 62 is adaptive in response to the state of feedback as output by the feedback monitor 86. For example, the ITE audio sound signal 60 of the at least one ITE microphone 26 may be used as the sole input source to the processor 18 in one or more frequency bands in which no feedback is currently present or emerging, whereas in one or more frequency bands in which feedback is present or evolving, the BTE audio sound signal 56 of the at least one BTE sound input transducer 14, 16 is applied to the signal processor 18 for provision of the required gain without feedback.

The signal combiner 62 may adaptively connect the ITE audio sound signal 60 of the at least one ITE microphone 26 as the sole input source to the processor 18 in one or more frequency channels in which no feedback instability is currently detected by the feedback monitor 86, and the BTE audio sound signal 56 of the at least one BTE sound input transducer 14, 16 in frequency channels with current risk of feedback as detected by the feedback monitor 86.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a BTE hearing aid housing configured to be worn behind a pinna of a user and accommodating at least one BTE sound input transducer configured for conversion of acoustic sound into a BTE audio sound signal;

an ITE microphone housing configured to be positioned in an outer ear of the user and accommodating at least one ITE microphone configured for conversion of acoustic sound into an ITE audio sound signal and accommodated by the ITE microphone housing;

a signal detector configured for determination of ITE signal magnitudes of the ITE audio sound signal at a plurality of frequencies, and determination of BTE signal magnitudes of the BTE audio sound signal at the plurality of frequencies;

a gain processor configured for determining gain values at respective frequencies of the plurality of frequencies based on the ITE signal magnitudes and the BTE signal magnitudes;

a multiplier configured for multiplying the BTE audio sound signal with the gain values at the respective frequencies to obtain a gain modified BTE audio sound signal; and a processing unit configured to generate a hearing loss compensated output signal based on the gain modified BTE audio sound signal.

2. The hearing aid according to claim 1, further comprising a signal combiner configured for combining the ITE audio sound signal with the gain modified BTE audio sound signal.

3. The hearing aid according to claim 1, wherein the signal combiner is configured for outputting a weighted sum of the ITE audio sound signal and the gain modified BTE audio sound signal.

4. The hearing aid according to claim 2, wherein the ITE audio sound signal and the BTE audio sound signal are divided into a plurality of frequency channels; and wherein the signal combiner is configured for forming individual weighted sums of the ITE audio sound signal and the gain modified BTE audio sound signal in at least some of the frequency channels.

5. The hearing aid according to claim 1, further comprising:

an adaptive feedback suppressor for feedback suppression, wherein the adaptive feedback suppressor comprises an input connected for reception of a hearing loss compensated output signal, and is configured to provide a first output and a second output modelling a feedback path aid to the respective at least one ITE microphone and the at least one BTE sound input transducer;

wherein the adaptive feedback suppressor is connected to at least one subtractor for subtraction of the respective first and second output of the adaptive feedback suppressor from respective output of at least one ITE microphone and the at least one BTE sound input transducer to provide respective difference signals, the at least one subtractor configured for outputting the respective difference signals as the respective ITE audio sound signal and BTE audio sound signal.

6. The hearing aid according to claim 5, further comprising:

a feedback monitor connected to the adaptive feedback suppressor and configured to monitor a state of feedback, the feedback monitor having an output providing an indication of the state of the feedback;

wherein the gain processor further has an input that is connected to the feedback monitor, and wherein the gain processor is configured for determination of the gain values at the respective plurality of frequencies based on the ITE signal magnitudes, BTE signal magnitudes and the state of the feedback.

7. The hearing aid according to claim 6, further comprising a signal combiner, wherein the signal combiner has an input that is connected to the feedback monitor, and wherein the signal combiner is configured for combining the ITE audio sound signal with the BTE audio sound signal in response to the state of the feedback.

8. The hearing aid according to claim 1, wherein the gain processor is configured for limiting the gain values so that a resulting gain of the hearing aid is kept below a maximum stable gain at the plurality of frequencies.

9. The hearing aid according to claim 1, wherein the ITE audio sound signal and the BTE audio sound signal are divided into a plurality of frequency channels, and wherein the signal detector is configured for individually processing the ITE audio sound signal and the BTE audio sound signal at the plurality of frequencies that correspond to respective ones of the plurality of frequency channels.

10. The hearing aid according to claim 1, wherein the ITE audio sound signal and the BTE audio sound signal are divided into a plurality of frequency channels; and wherein the at least one BTE sound input transducer is disconnected in a selected frequency channel of the plurality of frequency channels so that hearing loss compensation is based solely on the ITE audio sound signal in the selected frequency channel.

11. A method of preserving spatial cues in an audio sound signal, comprising:

converting acoustic sound into a first audio sound signal;

converting acoustic sound into a second audio sound signal using at least one microphone at an ear of a user, wherein spatial cues of the acoustic sound being converted into the second audio sound signal is preserved in the second audio sound signal;

determining a first set of signal magnitudes of the first audio sound signal at a plurality of frequencies;

determining a second set of signal magnitudes of the second audio sound signal at the plurality of frequencies;

determining gain values at respective frequencies of the plurality of frequencies based on the first set of signal magnitudes and the second set of signal magnitudes;

multiplying the first audio sound signal with the determined gain values at the respective frequencies; and generating a hearing loss compensated output signal based on a result from the act of multiplying the first audio sound signal with the determined gain values at the respective frequencies.

12. A method of suppressing feedback and preserving spatial cues in a hearing aid with at least one microphone with an operational position at an ear of a user, comprising:

converting acoustic sound into a first audio sound signal utilizing the at least one microphone, wherein the act of converting the acoustic sound into the first audio sound signal preserves spatial cues of the acoustic sound in the first audio sound signal;

converting acoustic sound into a second audio sound signal utilizing at least one BTE sound input transducer located behind a pinna of a user;

determining a first set of signal magnitudes of the first audio sound signal at a plurality of frequencies;

determining a second set of signal magnitudes of the second audio sound signal at the plurality of frequencies;

determining gain values at respective frequencies of the plurality of frequencies based on the first set of signal magnitudes and the second set of signal magnitudes;

multiplying the second audio sound signal with the determined gain values at the respective frequencies; and generating a hearing loss compensated output signal based on a result from the act of multiplying the second audio sound signal with the determined gain values at the respective frequencies.

* * * * *